United States Patent [19]

Wilhoite

[11] 4,108,144

[45] Aug. 22, 1978

[54] SUPPLEMENTAL AIR SUPPLY FOR A FIREPLACE

[75] Inventor: Murray O. Wilhoite, Huntsville, Ala.

[73] Assignee: Martin Industries, Inc., Huntsville, Ala.

[21] Appl. No.: 766,135

[22] Filed: Feb. 7, 1977

[51] Int. Cl.[2] ..... F24B 7/00

[52] U.S. Cl. ..... 126/120; 98/36; 126/85 B

[58] Field of Search ..... 126/120, 121, 131, 122, 126/143, 85 B; 98/36

[56] References Cited

U.S. PATENT DOCUMENTS

| | | | |
|---|---|---|---|
| 2,231,258 | 2/1941 | Elmore | 126/122 |
| 2,470,430 | 5/1949 | Carter | 126/120 |
| 2,497,486 | 2/1950 | Barber | 126/120 |
| 3,094,980 | 6/1963 | Inabnit | 126/121 |
| 3,113,501 | 12/1963 | Cargo | 98/36 |
| 4,010,728 | 3/1977 | Hempel et al. | 126/121 |
| 4,042,160 | 8/1977 | Ickes | 126/131 |
| 4,106,859 | 4/1977 | Landowski | 126/120 |

FOREIGN PATENT DOCUMENTS

| | | | |
|---|---|---|---|
| 961,433 | 6/1964 | United Kingdom | 126/120 |

*Primary Examiner*—Ronald C. Capossela
*Attorney, Agent, or Firm*—C. A. Phillips

[57] ABSTRACT

A fireplace having means for the injection of combustion and necessary dilution air consisting of a pair of louvered chambers positioned on each side of the front of the fireplace. Deflectors associated with the louvers direct the air inward and upward, whereby streams of air from the two louvered chambers combine in the central upper region of the fireplace opening and enter the fireplace. The supplemental air is obtained from outside the building housing the fireplace through a cased inlet or inlets on the outside wall of the building, the casing having an air entrance face which is outward of the wall by a dimension of approximately $\frac{1}{4}$ to $\frac{3}{4}$ inch.

5 Claims, 3 Drawing Figures

SUPPLEMENTAL AIR SUPPLY FOR A FIREPLACE

BACKGROUND OF THE INVENTION

1. Field of the Invention

This invention relates to indoor fireplaces, and particularly to a system of introducing supplemental combustion air.

2. General Description of the Prior Art

It is well known that the typical indoor fireplace in drawing its combustion and dilution air (the latter is needed to prevent smoking) from inside the building housing it is most inefficient. This arises because this air is sucked in around doors and windows, and, in fact, it is essential that the building have such leaks for the fireplace to function properly. These leaks often cool the building about as much as a fire in the fireplace warms it. Thus, ideally, means would be provided to introduce outside air directly into the fireplace, eliminating the objectionable cooling effect. While it might seem that all that one would have to do is to run a pipe from outside the building to any point inside the fireplace to satisfactorily achieve this, in practice, however, such is not the case if the often troublesome exit of smoke from the fireplace into living space is to be avoided. The applicant is unaware of any existing successful fireplace systems which solve this problem. It has heretofore been suggested that a manifold be provided all around the front of a fireplace which would be supplied by forced air from the outside of the building, and thus simulate air entering the fireplace from an adjoining interior of the building. It would appear that by such a construction, sufficiently balanced injection of air might be achieved to prevent smoking. However, the difficulty with this system is that it is necessary to have a manifold across the bottom of the fireplace, which is not at all convenient. Ashes would tend to clog it, and the provision of four housings, one on each side of the fireplace, results in a rather cumbersome structure and would be costly. Ideally, it would be desirable to eliminate one or two of the housings, and yet provide an injection of air in such a manner that smoking will not occur.

It is an object of this invention to reduce the number of air manifolds and to generally provide an improved air injection system.

SUMMARY OF THE INVENTION

In accordance with the invention, only two manifold housings are employed, vertically, one on each side of the fireplace, there being eliminated the upper and lower manifolds described above. In order to prevent smoke from exhausting back into the room, the two side manifolds have directional openings which deflect the air inward and upward toward an upper center of the fireplace, creating an increased pressure in this region. This, it has been found, is an ideal point or region of air injection and solves the smoking problem.

As a further feature of the invention, the air which is supplied to the manifolds from outside the building housing the fireplace is drawn from an air inlet register which has a grilled surface which is positioned from $\frac{1}{4}$ to $\frac{3}{4}$ inch from a vertical surface of a building on which it is mounted. By means of this construction, air pressures which tend to build up on the side of a building due to wind, and which would normally provide an undesired increased flow of air to the fireplace, are eliminated.

DETAILED DESCRIPTION OF THE DRAWINGS

Figure 2:
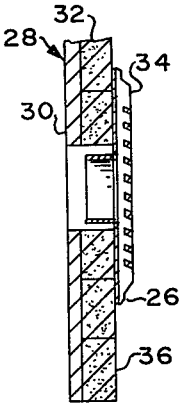
FIG. 2 is a sectional view along lines 2—2 of FIG. 1.
Figure 1:
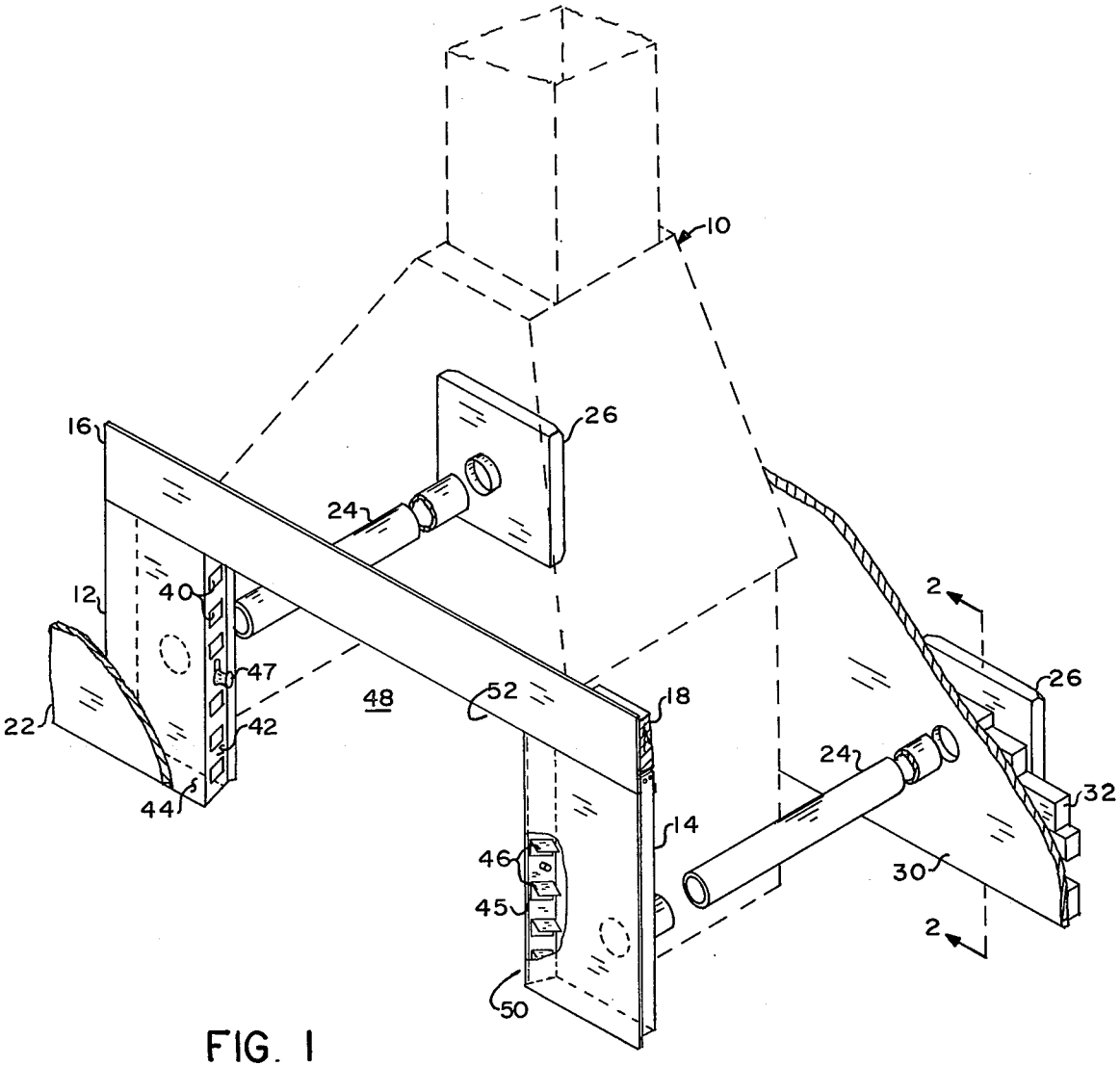
FIG. 1 is a pictorial illustration of a supplemental air system as contemplated by this invention.

Referring to FIG. 1, the general outline of an existing type fireplace enclosure 10 is illustrated in dashed lines. Manifolds 12 and 14 are vertically positioned on each side of the fireplace and are connected by "Z" frame member 16, upon which building structural framing 18 may be supported. Manifolds 12 and 14 supply air through pipes 24 from air inlet registers 26 positioned on the outside of exterior wall 28, shown to consist of an inner framed wall 30 and exterior brick wall 32. As will be noted in FIG. 2, air inlet register 26 has a discrete thickness (front to back), being approximately greater than $\frac{1}{4}$ inch and typically $\frac{1}{2}$ inch, and thereby face 34 of the inlet register is displaced outward from outer surface 36 of wall 28 by this amount. It has been discovered that by this means, the air pressure build-up due to wind striking wall 32 does not significantly appear at face 34 of register 26, and the draft in fireplace 10 is not significantly effected.

Manifolds 12 and 14 have adjustable louvered outlets 40 located on a surface 42 which is turned inward (from a vertical plane normal to the front surface 44 of the manifolds) 5 to 20 degrees to thereby direct the exiting air slightly inward. Outlets or exits 40 are adjusted in the opening area by a conventional slide gate 45 controllable by a knob 47 associated with each manifold. Deflectors 46 direct exiting air upward so that there is a convergence of air in an upper center region 48 of opening 50 of the fireplace. By virtue of this construction, the injected air is applied to chamber 52 in a region which not only supplies combustion and dilution air, but prevents exiting smoke through opening 50. Additionally, the injected air provides a desired cooling effect on the lintel or front face of the fireplace. Deflectors 46 are angled at an angle of 30° to 70° with respect to a vertical line to achieve the upper center convergence of air streams as described.

Figure 3:
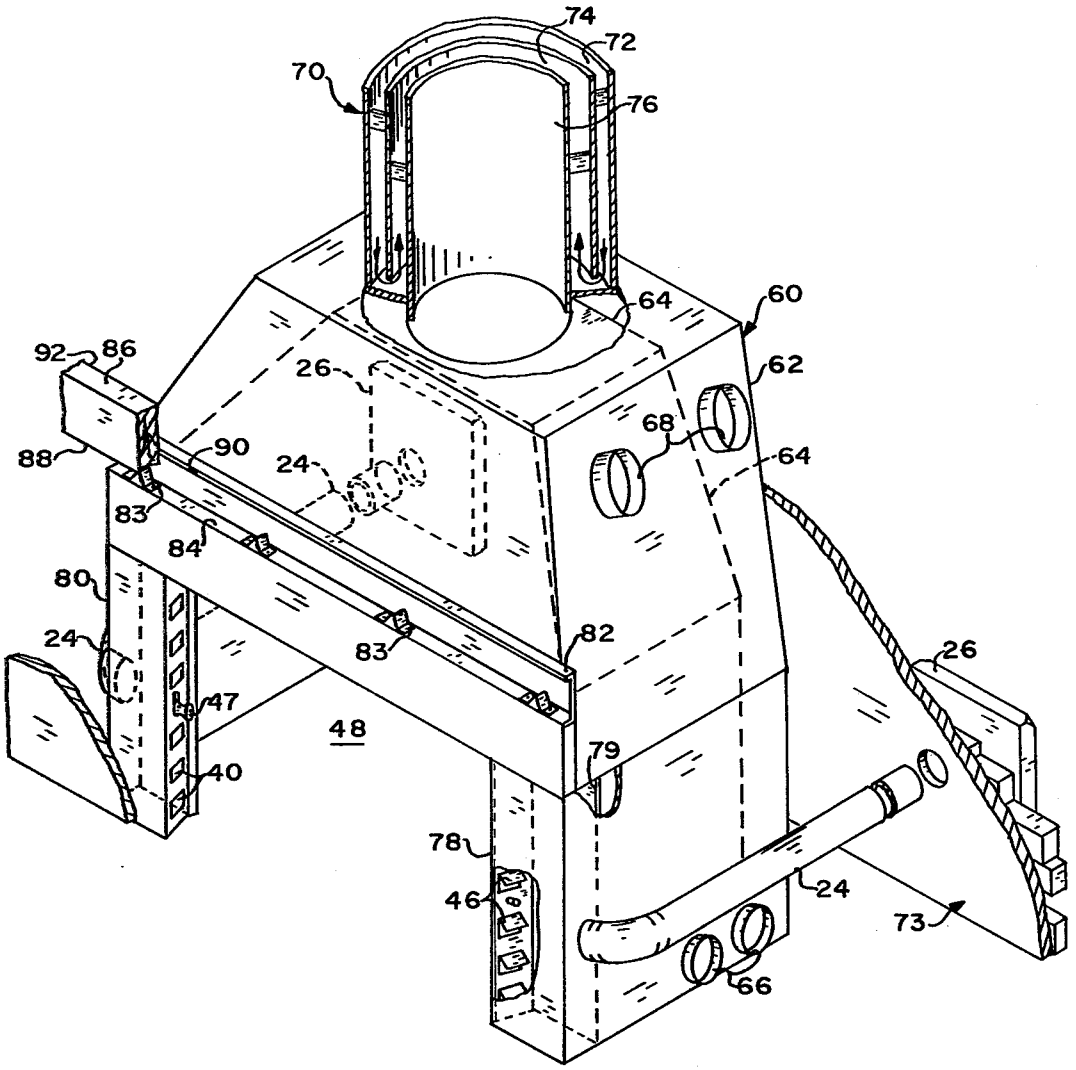
FIG. 3 is a pictorial view of a prefabricated type of fireplace assembly incorporating the supplementary air system of this invention.

FIG. 3 illustrates the incorporation of the invention in a complete prefabricated fireplace. As shown, fireplace 60 includes an outer jacket 62 and inner jacket 64 (generally conforming to fireplace 10 of FIG. 1), between which enclosures room air, introduced through lower inlets 66 (two on each side, with only the two on the right side shown) passes upward over the heated inner surface of jacket 64 and exits through upper exhaust outlets 68 (two on each side, with only the right two shown). Exiting heated air from outlets 68 is fed to a room register (not shown). This fireplace includes a cooling air arrangement for stack 70 wherein cooling air comes down through an annular passageway 74 from outside building 73 housing the fireplace, and this air then returns up through annular passageway 74 and exits outside the building, enabling a safe contact between the outside of stack 72 and combustible construction material. Opening 76 connects with the inside of the fireplace, and through it smoke and exhaust gases from the fireplace pass upward and out of the building. The structure is otherwise essentially identical with that shown in FIG. 1 except that manifolds 78 and 80, corresponding to manifolds 12 and 14 of FIG. 1, are attached to a front area of outer jacket 62 and sealed from it by vertical inner wall 79. The only entrance into manifolds 78 and 80 is via pipes 24, through which air from outside air is introduced for combustion as described above. "Z" bracket 16 of FIG. 1 is replaced by "U" channel 82, having a plurality of A-shaped pedestals 83 secured to lower flange 84 which support and termally isolate frame member 86 along its lower edge 88. Outer lip 90 of channel 82 provides a guide for and thermally isolates rear surface 92 of frame member 86.

The present invention provides a complete and workable system of direct injection of outside air into a fireplace without the attendant problems of smoke exiting from the fireplace. Further, in view of the provision of the raised surface of register 26, this is achieved in the presence of gusts of wind. By making unnecessary air leakage around doors, windows, etc., the efficiency of heating from the fireplace is dramatically improved, resulting is substantial savings in fuel.

Having thus described my invention, what is claimed is:

1. A fireplace comprising:

a firebox having an open front;

first and second manifolds, said manifolds being positioned on either side of said open front of said firebox;

air inlet means for introducing air into each of said manifolds;

a series of adjustably openable louvered openings on facing sides of said manifolds; and a plurality of deflectors positioned adjacent to the louvered openings and oriented upward in the direction of air flow out of said manifolds, whereby air is directed from each of said manifolds toward an upper central region of said open front of the fireplace and then into the fireplace.

2. A supplemental air supply for a fireplace as set forth in claim 1 wherein said manifolds have facing sides which turn inward toward the interior of the fireplace at an angle of 5° to 20° with respect to a vertical plane normal to the front opening of the fireplace.

3. A supplemental air supply for a fireplace as set forth in claim 2 wherein said deflectors are at an angle with respect to the horizontal of 30° to 70°.

4. A supplemental air supply for a fireplace as set forth in claim 1 wherein said air inlet means includes means for coupling through at least one opening in an outer wall of a building housing said fireplace to each of said manifolds, and includes an air register positionable over said opening on the outside of a building, and each said register has an outer inlet side and peripheral closing sides normal to said inlet side and extending normal to said inlet side a distance of at least ¼ inch toward said outer wall, whereby the outer inlet side is spacable from a building by said distance, and thereby air pressure arising from wind against the inlet side surface of the register is substantially reduced from that of air pressure otherwise at the surface of the building, and thus wind effects reaching said manifolds are substantially diminished.

5. A supplemental air supply for a fireplace as set forth in claim 4 further comprising:

a plenum around sides, back, and top portions of a fireplace and forming by its interior side a fireplace enclosure, and said plenum having a lower positioned inlet for receiving air from the interior of a building and an upper positioned air outlet for exhausting heated air passing through said plenum; and said manifolds being supported by, but air isolated from, said plenum.

* * * * *